United States Patent [19]

Wood

[11] 4,142,384

[45] Mar. 6, 1979

[54] TENSIONING KNITTED FABRIC

[75] Inventor: Gillies Wood, Leicester, England

[73] Assignee: Bentley Engineering Company Limited, England

[21] Appl. No.: 834,003

[22] Filed: Sep. 16, 1977

[30] Foreign Application Priority Data

Sep. 18, 1976 [GB] United Kingdom ..... 38793/76

[51] Int. Cl.[2] ..... D04B 15/92

[52] U.S. Cl. ..... 66/149 S

[58] Field of Search ..... 66/149 S, 149 R, 147

[56] References Cited

U.S. PATENT DOCUMENTS 3,473,350 10/1969 Scheel ..... 66/149 S
3,826,111 7/1974 Peberdy ..... 66/149 SX

FOREIGN PATENT DOCUMENTS 654672 10/1963 Belgium ..... 66/149 S
1197573 7/1965 Fed. Rep. of Germany ..... 66/149 S
1175131 12/1969 United Kingdom ..... 66/149 S

*Primary Examiner*—Werner H. Schroeder
*Assistant Examiner*—Andrew M. Falik
*Attorney, Agent, or Firm*—Robert E. Burns; Emmanuel J. Lobato; Bruce L. Adams

[57] ABSTRACT

In a circular knitting machine, means for tensioning the fabric as it is knitted, comprising one or more reciprocating resilient annular members within the needle cylinder for alternately trapping and downardly tensioning the fabric as it passes over the guide surface of a throat piece. Immediately thereafter the fabric is drawn further downwardly over a smooth annular rim of a suction tube, and entrained upwardly through the suction tube by air flow, thereby obtaining an even mechanical downward tensioning while drawing the fabric off upwardly.

10 Claims, 2 Drawing Figures

TENSIONING KNITTED FABRIC

Figure 1:
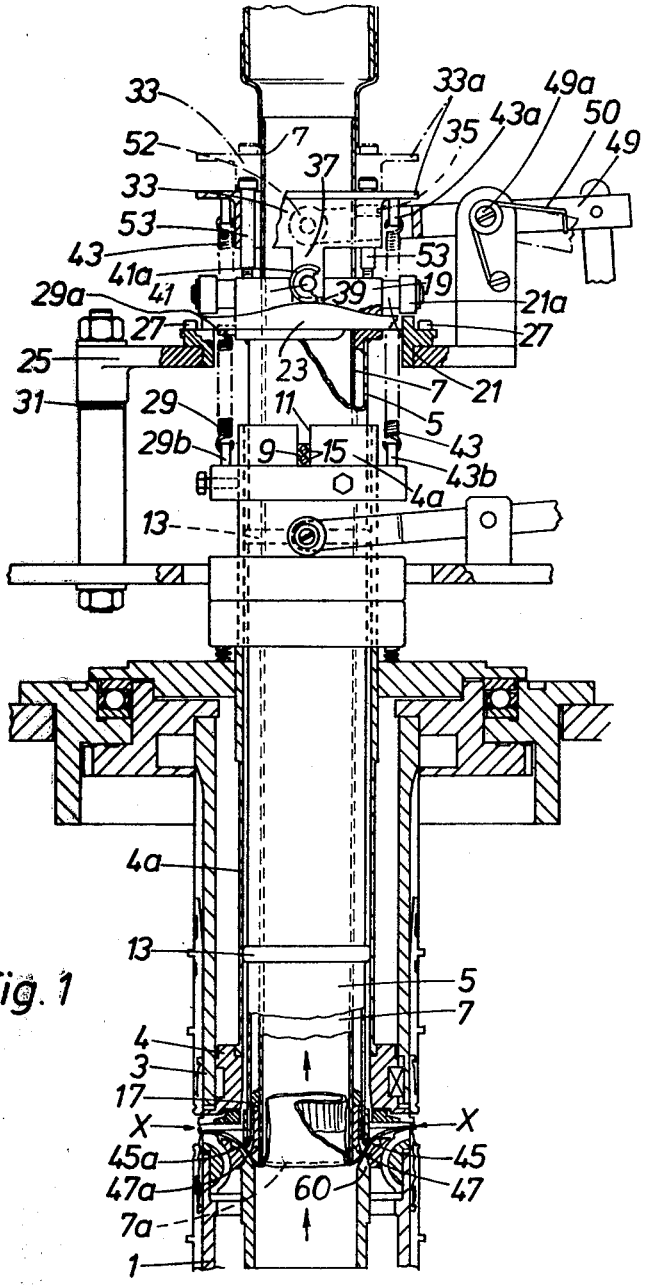

The invention relates to a method and apparatus for tensioning fabric as it is knitted on circular knitting machines, particularly but not exclusively for use with double cylinder circular knitting machines.

Conventionally fabric knitted on circular knitting machines is tensioned during knitting by mechanical means engaging the fabric, as for example is described and claimed in British Pat. No. 1,175,131, or by means of a current of air through the needle cylinder or cylinders. Imparting an even tension to the fabric during knitting enhances the quality and uniformity of the knitted structure.

This invention provides a method of tensioning fabric as it is knitted on a circular knitting machine, which comprises engaging the fabric with a mechanical member to draw it downwardly under tension, taking the fabric around the smooth rim of a suction tube and drawing the fabric off upwardly through the suction tube by entraining it in a current of air. By this means the fabric can be tensioned mechanically more uniformly than is practicable with solely pneumatic tensioning, and the advantages of pneumatic collection and upward draw-off can be obtained. It is surprising that satisfactory results can be obtained by a method which involves a change in the direction of travel of the fabric, but the method has proved to be advantageous in use producing consistently even-quality fabrics. It is believed that by introducing the suction tube for drawing fabric off upwardly centrally of the mechanical member, a substantially increased air passage is created which facilitates entrainment of the fabric in the air stream. In this way traction on the fabric during knitting appears to be increased. Because the fabric is drawn off upwardly, the knitted tube is produced in an inside-out condition which facilitates certain finishing operations or any other operations for which it is desirable to draw the fabric off upwardly. For knitting the first few courses of an article, the mechanical tensioning means is preferably disabled and raised to an inoperative position above the knitting level, and the fabric tensioned by the air stream alone.

This invention also provides apparatus for tensioning fabric as it is knitted on a circular knitting machine, comprising a throat piece for guiding fabric downwardly from the needles, one or more reciprocatory resilient annular members for engaging knitted fabric from above to trap it against the throat piece and tension it downwardly during knitting, and a suction tube extending upwardly centrally of the resilient annular member or members for entrainment of the knitted fabric upwardly in a current of air, the suction tube having a smooth annular rim around which the fabric can be drawn in use. If the apparatus is for use with a double cylinder knitting machine, the resilient annular member or members and the suction tube preferably depend within the upper cylinder, and the resilient annular member or members are preferably controlled by means above the upper cylinder.

The reciprocating movement of the or each resilient annular member, may be effected by a cam which repeatedly raises the member against the bias of spring means, so that the spring means provides the tensioning of the fabric. Either two reciprocating members can be provided, out of phase with each other to an extent to provide a substantially uniform tensioning of the fabric, or one such member can be used in association with a resilient member that resists motion of the fabric towards the needles but not away from the needles. Such devices are described fully in British Patent specification No. 1,175,131.

The air flow through the suction tube may be reversible, for example as described in British Patent specification No. 1,321,454, so as to eject the final article downwardly. Alternatively the article may be drawn off and taken off in the same upward direction. It may be advantageous at the start of knitting, when the annular resilient member or members and the suction tube are raised to a high inoperative position, to draw air in between the cylinders and upwardly through the suction tubes so as to assist the formation of the stitches of the first courses of the article.

Figure 2:
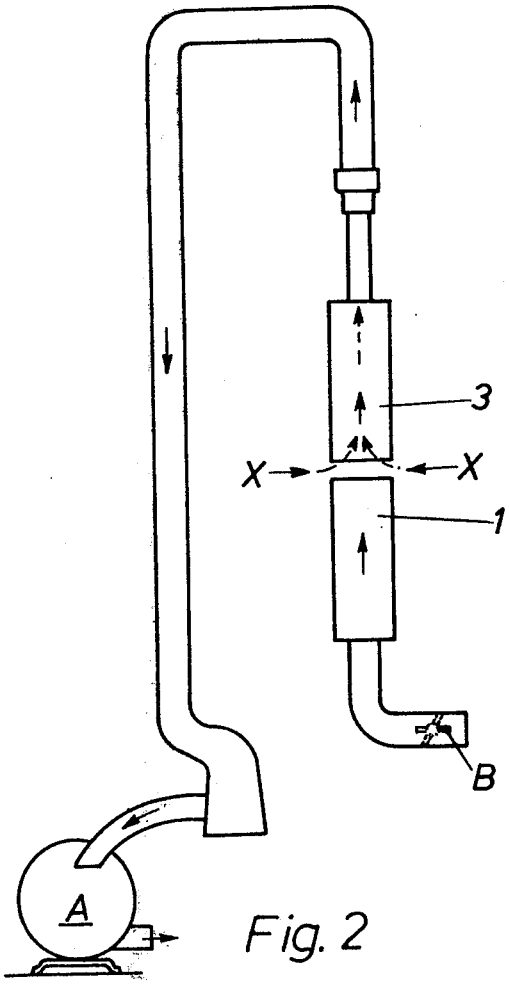

The invention is illustrated in the drawings of which:

FIG. 1 is a longitudinal section of a circular knitting machine cylinder incorporating the tensioning device; and FIG. 2 is a schematic diagram of an air take off device.

Referring to FIG. 1, two needle cylinders 1 and 3 spaced apart on a common axis form a part of the machine, and at the space X provided between the cylinders the article is knitted to be forwarded into the axial cavity of the cylinder 1. The cylinder 1 is provided at its upper end with a throat piece 60, and has rotational speed corresponding to the article being formed.

The cylinder 3 whose rotational speed is the same as the cylinder 1, houses a vertically extending tube **4*a* fixed to the verge ring 4. The verge ring is keyed to the cylinder 3 in the usual manner. Two tubular elements 5 and 7, one inside the other, are mounted within the verge tube 4*a*, and are capable of relative sliding motion in the axial direction both with respect to each other, and with respect to the cylinder 3 and the verge tube 4*a*. The tubular element 5 is coupled to the verge tube 4*a* by a key 9 which is fixed to the tubular element 5 with screws 15 and is housed in a longitudinal slot 11 of the verge tube 4*a*. The rings 13 fixed to the tubular element 5, are located in the bore of the verge tube 4*a*, and provide bearing surfaces when the tubular element 5 is axially displaced, likewise a ring 17 attached to the tubular element 7 acts as a spacer between the tubular elements 5 and 7 and provides a bearing when the tubular element 7** is axially displaced.

Fixed to the upper end of the tubular element 5, by means such as welding or brazing, is a circular bracket 19, on the outer face of which a pair of radial roller carrying arms 21, are fixed diametrically opposed on the same horizontal plane.

The rollers **21*a*, rotatably mounted on the arms 21, engage the upper face of an annular cam 23, coaxial with the cylinder axis, which is carried on a stationary structure 25, of the machine and fixed by a plurality of screws 27. The rollers 21*a* are biassed against the undulating upper face of the cam 23, by tension springs such as the spring 29, which is attached to the spring anchor pins 29*a* and 29*b***.

Axial adjustment of the cam 23, and the tubular element 5, is provided by shims 31, located underneath the stationary structure 25.

The bore of the circular bracket 19, is so dimensioned as to permit free axial movement of the tubular element 7, and the tubular element 5.

Towards the upper end of the tubular element 7, is another circular bracket 33, locked in position by screws 35. The bracket 33, has two depending arms 37, located in the slots 39, cut in the bracket 19, by which means the tubular element 7 is caused to rotate with the tubular element 5. The slots 39, diametrically opposed in the bracket 19, are spaced at approximately 90° from the roller arms 21.

The roller arms 41, radially set into the depending arms 37 carry the rollers 41*a*, which are biassed against the upper undulating face of the cam 23, by tension springs 43, which are attached to the spring anchor pins 43*a* and 43*b*.

Each of the tubular elements 5 and 7, carries at the lower end an axially extending resilient sleeve 45 and 47 respectively. The two sleeves are of resilient material such as natural or synthetic rubber.

The lower edges 45*a* and 47*a* of the respective sleeves lie adjacent the throat piece 60 of the cylinder 1 and co-operate therewith when the respective assembly 5, 19 or 7, 33 is lowered by the corresponding spring 29 or 43.

The smooth lower edge 7*a* of the tubular element 7 is made to stand below the lower edge 47*a* of the resilient sleeve 47, so that as the fabric is generated by the needles it passes under the smooth edge 7*a*, to be entrained in an upward direction by an air current through the bore of the tubular element 7, as shown in FIG. 1.

It is necessary when the machine is reciprocating in order to knit the heel and toe pouches, that the tubular element assemblies 5 and 7 are moved upwards to an inoperative position shown in FIG. 1 by the dot dash outline of the circular bracket 33.

This upward movement is programmed from the main control drum of the machine, and is brought about through the action of a forked lever 49, which is caused to pivot on its axle pin 49*a*. During this movement a pair of rollers 52 mounted diametrically opposed on the forks of the lever 49, come into contact with the underside face of a flange 33*a* on the bracket 33, causing it to rise with the tube 7 to an inoperative position.

In order to transmit the upward movement of the bracket 19, and the tube 5, a pair of shoulder screws 53 are screwed into the bracket 19, passing through clearance holes in the bracket 33.

It will be seen, therefore, that during the upward movement of the bracket 33, the upper face of the flange 33*a* will come into contact with the heads of the screws 53 causing the tube assembly 5 to move in an upwards direction together with the tube assembly 7, until the rollers 21*a* and 41*a* are clear of the undulating upper face of the cam 23. The length of the shoulder screws 53 is such that when the tube assemblies are in the lowered (operative) position, the tube 7 and its bracket 33 can be raised and lowered by the cam 23 independently of the tube 5 and its bracket 19.

When the fabric tensioning device is lowered to the operative position, the axial movement of the tubular elements 5 and 7, and the action of the resilient sleeves 45 and 47 on the fabric, follow the same operating sequence as that disclosed in the British Patent specification No. 1,175,131.

In the lowered (operative) position of the tensioning device, the forked lever 49 is maintained with its rollers 52 out of contact with the flange 33*a* by virtue of the spring 50.

In FIG. 2, an air take off device is shown having a fan unit "A" drawing air in a direction shown by the arrows through the cylinders 1 and 3.

At the start of a new article a valve B is brought to a closed position (dotted) so that air is sucked in at a position X.

When sufficient fabric has been made for the tensioning device to engage it, the valve B is brought to its open position as shown so that the fabric is entrained upwardly by the air flow through the inner tube 7 of the tensioning device.

We claim:

1. A circular knitting machine having a cylindrical array of needles for knitting fabric and means for tensioning the fabric as it is knitted, wherein the tensioning means comprises:

a throat piece within the cylindrical array of needles;

a guide surface on the throat piece for guiding fabric downwardly from the needles as it is knitted;

at least one reciprocating resilient annular member movable downwardly over the guide surface of the throat piece to trap and downwardly tension any fabric thereon;

means for effecting vertical reciprocatory movement of said annular member;

a suction tube extending upwardly centrally of said annular member;

means for creating an air flow through the suction tube to entrain fabric upwardly; and a smooth annular rim of the suction tube around which the fabric is drawn as it passes down the guide surface and then upwardly through the suction tube, said smooth annular rim being lower than said annular member.

2. A knitting machine according to claim 1, wherein two of said reciprocatory resilient annular members are provided and are movable out of phase with each other to an extent to provide substantially uniform tensioning of the fabric.

3. A knitting machine according to claim 2 including means for moving the resilient annular members between an operative tensioning position and an inoperative non-tensioning position to thereby permit take down of initial fabric portions by air flow alone.

4. A knitting machine according to claim 1, wherein said knitting machine has coaxial superposed upper and lower rotating needle cylinders, a vertical reciprocable tubular element extending through said upper cylinder, said annular member being carried on a lower end portion of said tubular element and means above said upper cylinder for reciprocating said tubular element and thereby reciprocating said annular member.

5. A knitting machine according to claim 4, wherein said means for reciprocating said tubular element comprises cam followers on an upper end portion of said tubular element and cam means engaged by said cam followers to reciprocate said tubular element.

6. A knitting machine according to claim 2, wherein said knitting machine has coaxial superposed upper and lower needle cylinders, two coaxial vertical reciprocable tubular elements extending through said upper cylinder, said two annular members being carried respectively on lower end portions of said tubular elements and means above said upper cylinder for reciprocating said tubular elements out of phase with one another and thereby reciprocating said annular members.

7. A knitting machine according to claim 6, wherein said means for reciprocating said tubular elements comprises cam followers on upper end portions of said tubular elements respectively and cam means engaged by said cam followers to reciprocate said tubular elements, said cam followers on one said tubular element being angularly displaced relative to said cam followers on the other of said tubular elements whereby said tubular elements are reciprocated out of phase with one another.

8. A knitting machine according to claim 7, comprising means for raising said tubular elements so that said cam followers do not engage said cam means, thereby rendering said annular members inoperative.

9. A knitting machine according to claim 4, wherein said annular member comprises a resilient rubber sleeve on the lower end of said tubular element.

10. A knitting machine according to claim 6, wherein said annular members comprise a resilient rubber sleeve on the lower end of each of said tubular elements.

* * * * *